US009118147B1

(12) United States Patent
Sharf

(10) Patent No.: US 9,118,147 B1
(45) Date of Patent: Aug. 25, 2015

(54) ELECTRICAL CONNECTOR

(71) Applicant: Tyco Electronics Corporation, Berwyn, PA (US)

(72) Inventor: Alex Michael Sharf, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 8 days.

(21) Appl. No.: 14/184,319

(22) Filed: Feb. 19, 2014

(51) Int. Cl.
*H01R 13/631* (2006.01)
*H01R 12/70* (2011.01)
*H01R 12/75* (2011.01)
*H01R 13/652* (2006.01)

(52) U.S. Cl.
CPC ..... *H01R 13/631* (2013.01); *H01R 12/7082* (2013.01); *H01R 12/75* (2013.01); *H01R 13/652* (2013.01)

(58) Field of Classification Search
CPC ..... H01R 9/2408; H01R 13/514; H01R 9/26; H01R 23/725; H01R 9/091
See application file for complete search history.

(56) References Cited

U.S. PATENT DOCUMENTS

| | | | | | |
|---|---|---|---|---|---|
| 3,212,051 | A * | 10/1965 | Clewes | 439/717 |
| 3,474,397 | A * | 10/1969 | Piasecki | 439/717 |
| 4,227,768 | A * | 10/1980 | Clewes et al. | 439/717 |
| 4,575,177 | A * | 3/1986 | Knickerbocker | 439/717 |
| 5,288,251 | A * | 2/1994 | Sumida | 439/701 |
| 5,961,350 | A | 10/1999 | Shiu | |
| 6,575,783 | B1 * | 6/2003 | Wu | 439/540.1 |
| 7,195,519 | B1 * | 3/2007 | McAlonis et al. | 439/607.39 |
| 8,074,680 | B2 * | 12/2011 | De Carolis et al. | 137/560 |
| 8,529,300 | B2 * | 9/2013 | Ritter et al. | 439/701 |
| 2002/0146941 | A1 * | 10/2002 | Bradley | 439/701 |
| 2013/0072071 | A1 * | 3/2013 | Ritter et al. | 439/717 |

* cited by examiner

*Primary Examiner* — Gary Paumen

(57) ABSTRACT

An electrical connector includes a housing holding an array of contacts. The housing has opposite first and second sides and opposite first and second ends. The housing has a base. The housing has side walls extending from the base at the first and second sides of the housing with a cavity defined between the side walls. The contacts are arranged in the cavity. The cavity is configured to receive a mating connector along a mating axis in a vertical direction. The housing includes a first end wall at the first end of the housing extending between the opposite side walls. The housing includes a second wall at the second end of the housing extending between the opposite side walls. The second end wall may be vertically offset with respect to the first end wall.

20 Claims, 7 Drawing Sheets

ELECTRICAL CONNECTOR

BACKGROUND

The subject matter herein relates generally to electrical connectors.

Some electrical systems, such as network switches and computer servers with switching capability, include electrical connectors mounted to circuit boards. The electrical connectors may be mounted to a circuit board, and a receptacle connector may be mounted to another circuit board. The electrical connector receives the receptacle connector. The electrical connector typically includes a base having side walls and a gap therebetween. Multiple contacts are positioned in the gap. The contacts are electrically connected to traces in the circuit board on which the electrical connector is mounted. In other electrical systems, the electrical connectors terminate to cables rather than a circuit board.

However, conventional electrical connectors have experienced certain limitations. It is desirable to strengthen the side walls to increase the structural rigidity of the electrical connector. However, traditional methods for bracing the side walls include structural members that interfere with attempts to arrange the electrical connectors in a dense array. For example, it is desirable to position several electrical connectors adjacent to one another in order to create an electrical connector array. To decrease the amount of rack space occupied by the array, it is desirable to position the electrical connectors as close as possible. The structural members between side walls limit tight spacing of the electrical connectors. For example, the structural member of one electrical connector may abut against the structural member of an adjacent electrical connector. Thus, the structural members decrease the number of connectors that fit within a given space of the circuit board.

A need remains for an electrical connector that has good structural rigidity and that can be arranged in a dense array with other electrical connectors.

BRIEF DESCRIPTION

In an embodiment, an electrical connector is disclosed. The electrical connector includes a housing holding an array of contacts. The housing has opposite first and second sides and opposite first and second ends. The housing has a base. The housing also has side walls extending from the base at the first and second sides of the housing with a cavity defined between the side walls. The contacts are arranged in the cavity. The cavity is configured to receive a mating connector along a mating axis in a vertical direction. The housing also includes a first end wall at the first end of the housing extending between the opposite side walls. The housing also includes a second wall at the second end of the housing extending between the opposite side walls.

In an embodiment, an electrical connector array is disclosed. The electrical connector array includes a first electrical connector. The electrical connector array includes a second electrical connector configured to be mounted adjacent to the first end of the first electrical connector. The first electrical connector includes an array of contacts and a first housing holding the contacts. The first housing has opposite first and second sides and opposite first and second ends. The first housing has a base. The first housing also has side walls extending from the base at the first and second sides of the first housing with a cavity defined between the side walls. The contacts are arranged in the cavity. The cavity is configured to receive a mating connector along a mating axis extending in a vertical direction. The first housing has a first end wall at the first end of the first housing extending between the opposite side walls and the first housing has a second end wall at the second end of the first housing extending between the opposite side walls. The second end wall is vertically offset with respect to the first end wall along the mating axis. The second electrical connector includes an array of contacts and a second housing holding the contacts. The second housing has opposite first and second sides and opposite first and second ends. The second housing has side walls extending from the base at the first and second sides of the second housing with a cavity defined between the side walls. The contacts are arranged in the cavity. The cavity is configured to receive a mating connector along the mating axis. The second housing has a first end wall at the first end of the second housing extending between the opposite side walls and the second housing has a second end wall at the second end of the second housing extending between the opposite side walls. The second end wall is vertically offset with respect to the first end wall extending along the mating axis. The second electrical connector is positioned relative to the first electrical connector such that the second end wall of the second housing is aligned below the first end wall of the first housing and the circuit board such that the second end wall of the second housing is positioned between the first end wall of the first housing and the circuit board.

DETAILED DESCRIPTION

Figure 1:
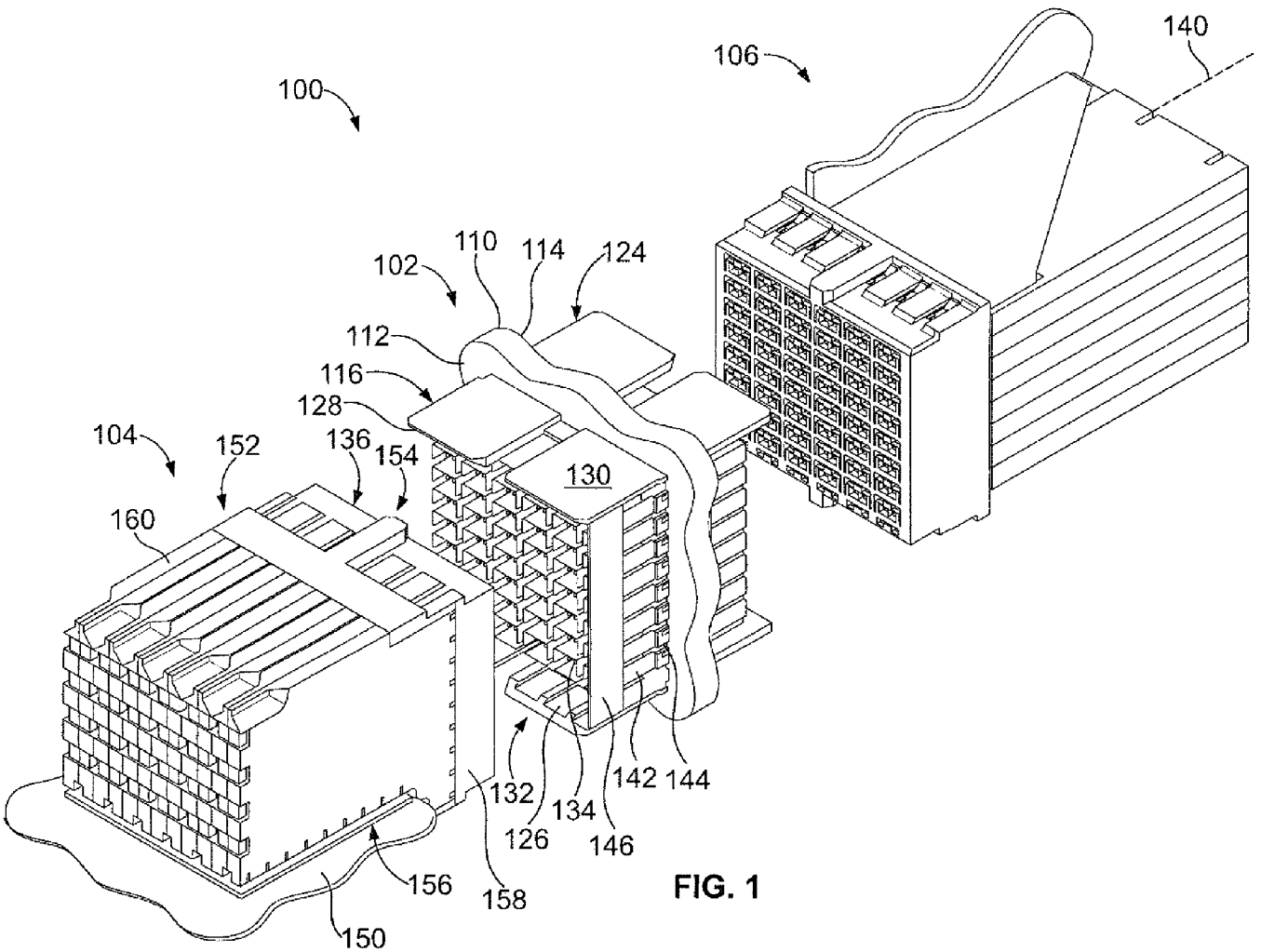
FIG. 1 is a perspective view of a connector system formed in accordance with an exemplary embodiment.

FIG. 1 is a perspective view of a connector system 100 formed in accordance with an exemplary embodiment. In the illustrated embodiment, the connector system 100 defines a midplane connector system. The connector system 100 includes a midplane assembly 102, a first connector assembly 104 configured to be coupled to one side of the midplane assembly 102 and a second connector assembly 106 configured to be connected to a second side the midplane assembly 102. The midplane assembly 102 is used to electrically connect the first and second connector assemblies 104, 106. Optionally, the first connector assembly 104 may be part of a daughter card and the second connector assembly 106 may be part of a backplane, or vice versa. The first and second connector assemblies 104, 106 may be elements of line cards or switch cards. In alternate embodiments, rather than a midplane system, the connector system 100 may be used without the midplane assembly such as a system including two connector assemblies and two circuit boards that are connected by the two connector assemblies.

In the illustrated embodiment, the electrical connector 116 is a high-speed differential pair cable connector that includes a plurality of differential pairs of conductors mated at a common mating interface. The differential conductors are shielded along the signal paths thereof to reduce noise, crosstalk, and other interference along the signal paths of the differential pairs. In various embodiments, the electrical connector 116 may be embodied as a header connector, a receptacle connector, or another type of shrouded electrical connector. For example, the electrical connector 116 may be fully shrouded with walls on all sides of the cavity, such as on four sides of the cavity. In the illustrated embodiment, the electrical connector is a header connector, such as a STRADA Whisper header connector, commercially available from TE Connectivity of Harrisburg, Pa. Alternatively, the electrical connector may be a receptacle connector, such as a STRADA Whisper receptacle connector, commercially available from TE Connectivity of Harrisburg, Pa.

The midplane assembly 102 includes a circuit board 110 having a first side 112 and second side 114. The assembly 102 includes an electrical connector 116 mounted to and extending from the first side 112 of the circuit board 110. Optionally, multiple electrical connectors 116 may be mounted to the circuit board 110 in a stacked arrangement to form an electrical connector array, such as the electrical connector array 122 (shown in FIG. 6), which includes the electrical connectors 118, 120 in addition to the electrical connector 116. The assembly 102 includes another electrical connector 124 mounted to and extending from the second side 114 of the circuit board 110, which may be similar or identical to the electrical connector 116. Alternatively, the assembly 102 only includes a single electrical connector, such as the electrical connector 116, mounted on the first side 112 of the circuit board 110.

The electrical connector 116 includes a housing 130 having a first side wall 126 and a second side wall 128 forming a cavity 132 therebetween. The signal contacts 134 are arranged in the cavity 132 and are configured to be electrically connected to signal contacts of a mating connector 136 of the first connector assembly 104 when the mating connector 136 is plugged into the cavity 132 along a direction parallel to the mating axis 140.

The electrical connector 116 includes header ground contacts 142 that provide electrical shielding around corresponding header signal contacts 134. In an exemplary embodiment, header signal contacts 134 are arranged in pairs configured to convey differential signals. The header ground contacts 142 peripherally surround a corresponding pair of header signal contacts 134. In an exemplary embodiment, the header ground contacts 142 are C-shaped, covering three sides of the pair of header signal contacts 134; however other shapes are possible in alternative embodiments. Optionally, multiple ground contacts 142 may surround the header signal contacts 134.

The housing 130 holds the array of header signal contacts 134 and the header ground contacts 142. The housing 130 is manufactured from a dielectric material, such as a plastic material. The housing 130 includes a base 144 that may be configured to be mounted to the circuit board 110. The housing 130 includes the first and second side walls 126, 128, respectively extending from the base 144. The side walls 126, 128 shroud portions of the header signal contacts 134 and the header ground contacts 142. The mating connector 136 is received in the cavity between the side walls 126, 128. The side walls 126, 128 may guide the mating connector 136 into the cavity 132. In an exemplary embodiment, the housing 130 includes a first end wall 146 and a second end wall 148 (shown in FIG. 3) extending between the first and second side walls 126, 128. The end walls 146, 148 provide structural support for the side walls 126, 128.

The first connector assembly 104 includes a first circuit board 150 and a first receptacle assembly 152 coupled to the first circuit board 150. The first receptacle assembly 152 is configured to be coupled to the electrical connector 116. The first receptacle assembly 152 has a header interface 154 configured to be mated with the electrical connector 116. The first receptacle assembly 152 has a board interface 156 configured to be mated with the first circuit board 150. In an exemplary embodiment, the board interface 156 is orientated perpendicular with respect to the header interface 154. When the first receptacle assembly 152 is coupled to the electrical connector 116, the first circuit board 150 is orientated perpendicular with respect to the circuit board 110. In other embodiments, the first receptacle assembly 152 may have a different orientation than circuit board 110.

The first receptacle assembly 152 includes a front housing 158 which holds an array of contact modules 160. The contact modules 160 are held in a stacked configuration generally parallel to one another. The contact modules 160 hold a plurality of receptacle signal contacts (not shown) that are electrically connected to the first circuit board 150 and define signal paths through the first receptacle assembly 152. The receptacle signal contacts are configured to be electrically connected to the header signal contacts 134 of the electrical connector 116. In an exemplary embodiment, the contact modules 160 provide electrical shielding for the receptacle signal contacts. Optionally, the receptacle signal contacts may be arranged in pairs carrying differential signals. In an exemplary embodiment, the contact modules 160 generally provide 360° shielding for each pair of receptacle signal contacts along substantially the entire length of the receptacle signal contacts between the board interface 156 and the header interface 154. The shield structure of the contact modules 160 that provides the electrical shielding for the pairs of receptacle signal contacts is electrically connected to the header ground contacts 142 of the first electrical connector 116 and is electrically connected to a ground plane of the first circuit board 150.

Figure 2:
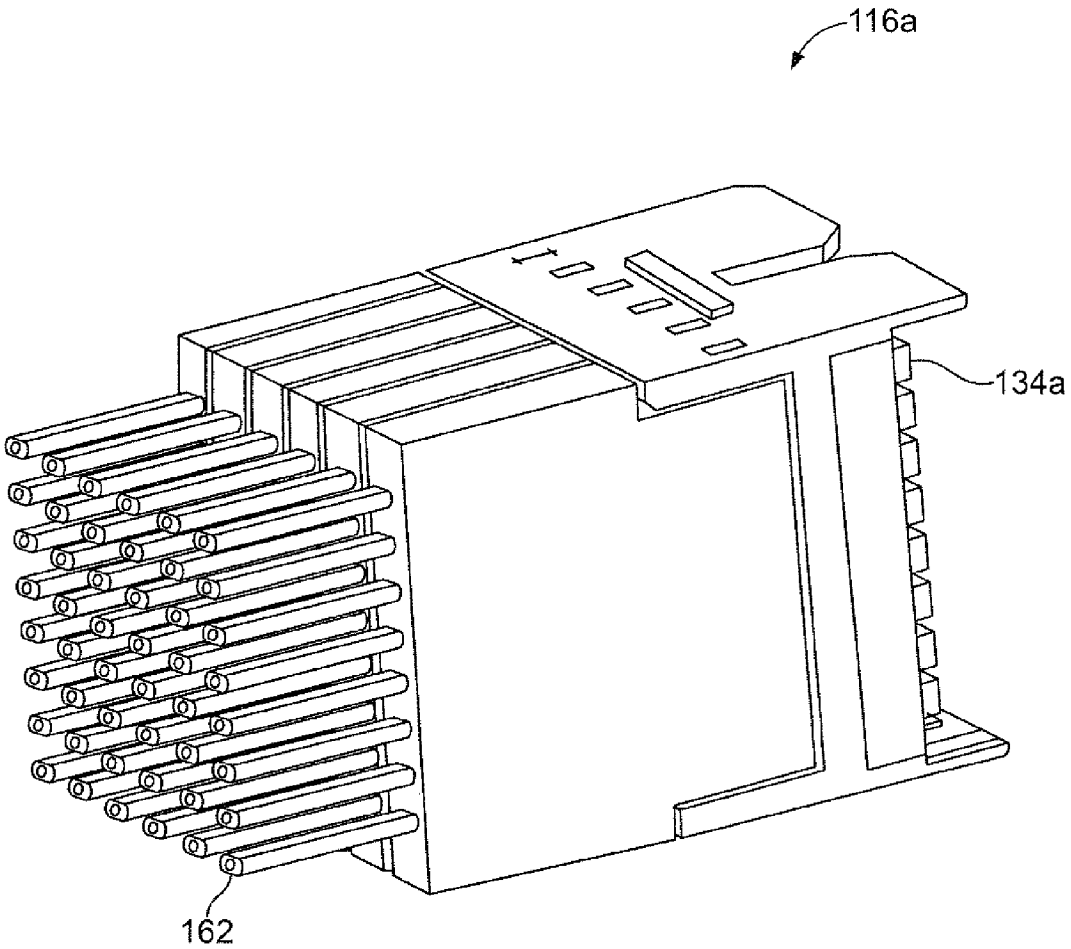
FIG. 2 is a perspective view of an electrical connector configured as a cable connector in accordance with an exemplary embodiment.

FIG. 2 is a perspective view of an electrical connector 116*a* formed in accordance with an alternative embodiment and configured as a cable connector rather than a board mounted connector. Signal contacts 134*a* of the electrical connector are terminated to cables 162.

Figure 3:
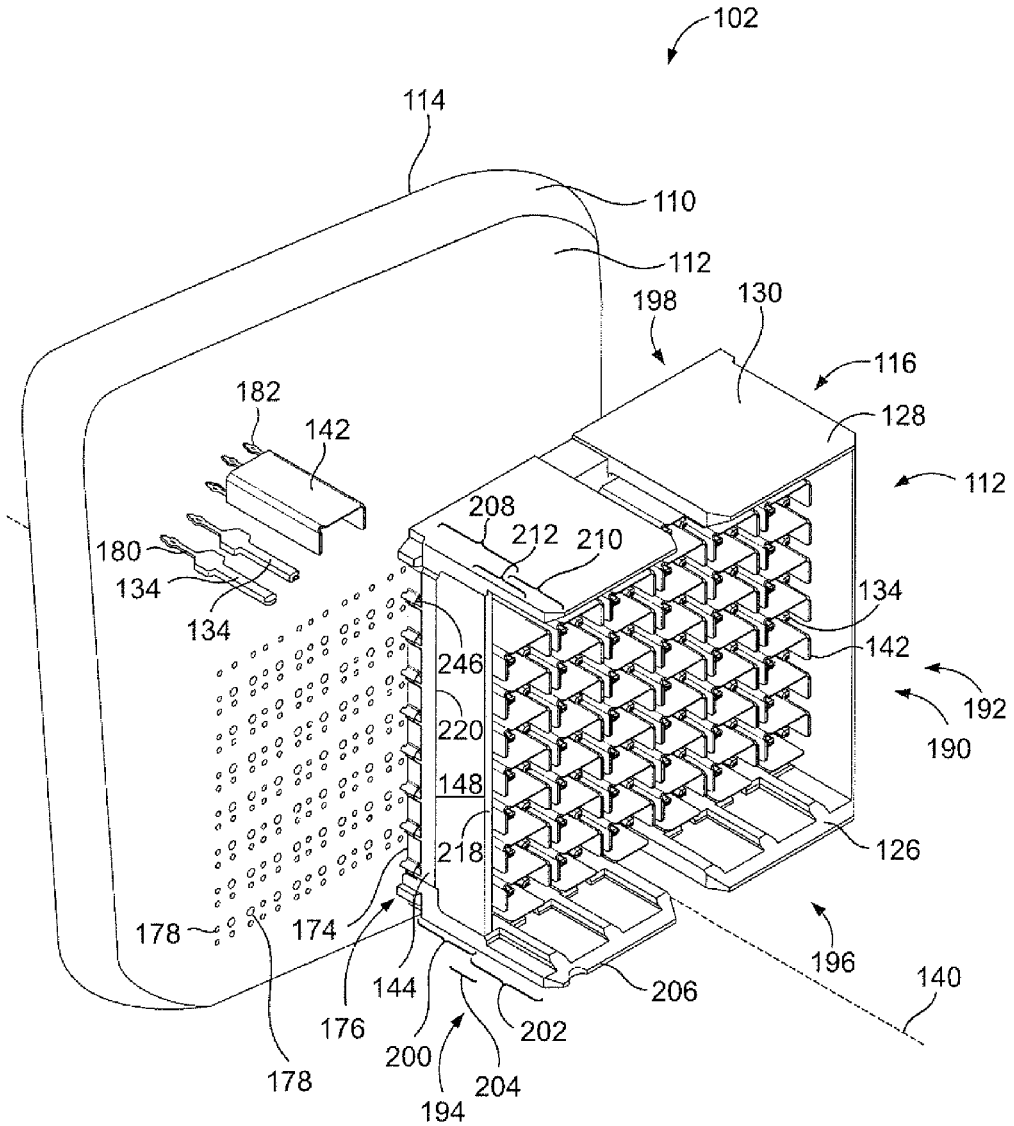
FIG. 3 is an exploded view of an assembly showing an electrical connector poised for mounting to a circuit board in accordance with an exemplary embodiment.

FIG. 3 is an exploded view of the midplane assembly 102 showing the electrical connector 116 poised for mounting to the circuit board 110. The base 144 includes a mounting surface 174 at a bottom 176 of the housing 130. The mounting surface 174 allows the base 144 to mate with the circuit board 110. The signal contacts 134 are configured to be terminated to the circuit board 110. Conductive vias 178 extend through the circuit board 110 between the first and second sides 112, 114. Some of the conductive vias 178 receive pins or tails of the header signal contacts 134 of the electrical connector 116. Some of the conductive vias 178 are configured to receive pins or tails of the header ground contacts 142.

In an exemplary embodiment, the header signal contacts 134 include compliant pins 180 that are configured to be loaded into corresponding conductive vias 178. The compliant pins 180 are mechanically and electrically connected to the conductive vias 178. In an exemplary embodiment, the header ground contacts 142 include compliant pins 182 that are configured to be received in corresponding conductive vias 178. The compliant pins 182 are mechanically and electrically connected to the conductive vias 178.

The housing 130 of the electrical connector 116 has a top 190 diametrically opposed to the bottom 176. The housing 130 also has a first end 192, a second end 194, a first side 196 and a second side 198.

The first side wall 126 extends from the first end 192 to the second end 194 along the first side 196. The first side wall 126 extends from the base 144 to the top 190 of the housing 130. The first side wall 126 includes a lower section 200 and an upper section 202. The lower section 200 extends from the base 144 to a center portion 204. Optionally, the center portion 204 may be at or near the midpoint between the base 144 and the top 190. The upper section 202 extends from the center portion 204 to the top 190 of the housing 130.

The second side wall 128 extends from the first end 192 to the second end 194 along the second side 198. The second side wall 128 extends from the base 144 to the top 190 of the housing 130. The second side wall 128 includes a lower section 208 and an upper section 210. The lower section 208 extends from the base 144 to a center portion 212.

The side walls 126, 128 include tips 206 at the top 190 of the housing 130. The tips 206 may be shaped (for example, beveled or chamfered) to encourage mating between the electrical connector 116 and the mating connector 136. For example, the tips 206 may be tapered. As another example, the tips 206 may be rounded. The tips 206 on the first side wall 126 may be the same or different than the tips 206 on the second side wall 128.

The housing 130 includes the first and second end walls 146, 148, respectively. The end walls 146, 148 provide structural support for the side walls 126, 128. The end walls 146, 148 limit transverse movement of the side walls 126, 128 relative to the mating axis 140, such as during mating with the mating connector 136 (shown in FIG. 1). The end walls 146, 148 increase the torsional rigidity of the electrical connector 116. Additionally, the end walls 146, 148 may prevent damage (for example, impact damage) to the signal contacts 134 and the ground contacts 142 during mating.

The second end wall 148 extends between the opposite side walls 126, 128. The second end wall 148 extends from the first side wall 126 to the second side wall 128 along the base 144 of the housing 130. The second end wall 148 includes an upper edge 218 and a lower edge 220. The upper edge 218 extends along a top of the second end wall 148. The lower edge extends along the bottom of the second end wall 148. In various embodiments, the lower edge 220 may be at or near the base 144. The second end wall 148 extends between the lower section 200 of the first side wall 126 and the lower section 208 of the second side wall 128.

Figure 4:
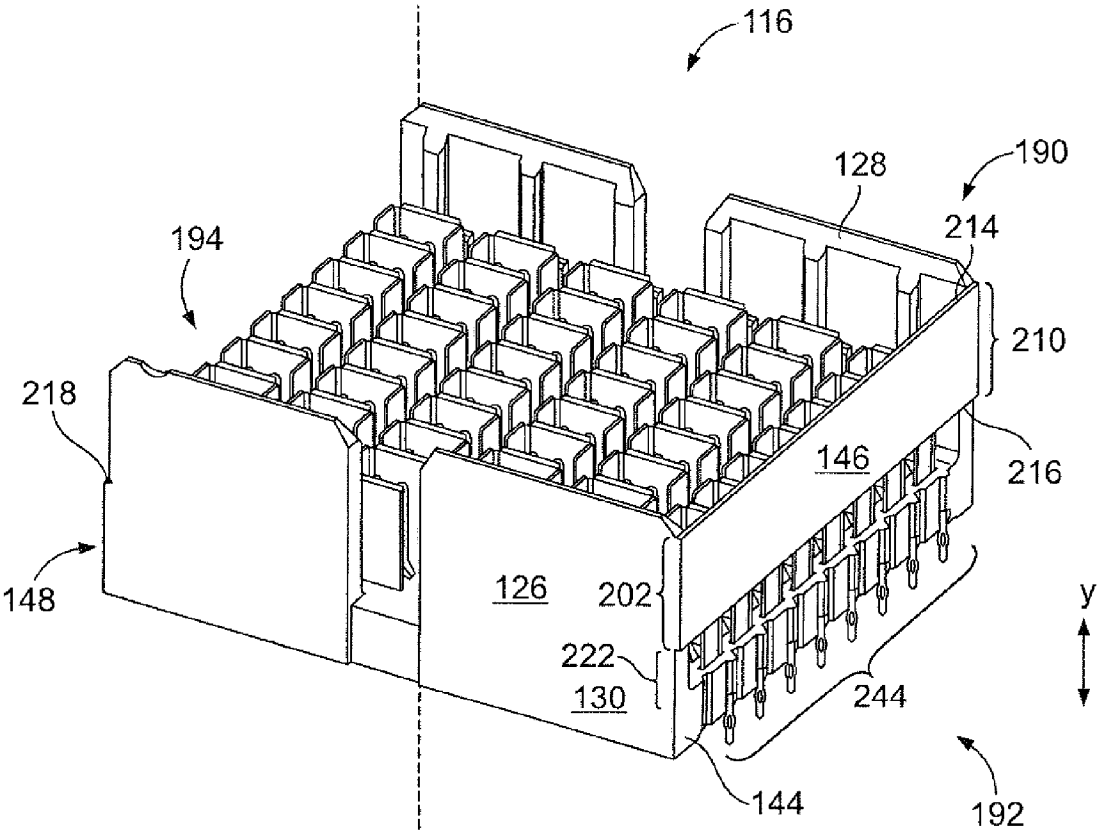
FIG. 4 is a front perspective view of an electrical connector in accordance with an exemplary embodiment.

FIG. 4 is a front perspective view of the electrical connector 116 in accordance with an exemplary embodiment. As shown in FIG. 4, the first end wall 146 extends from the first side wall 126 to the second side wall 128. Optionally, the first end wall 146 may be provided at or near the top 190 of the housing 130. The first end wall 146 includes an upper edge 214 and a lower edge 216. The upper edge 214 extends along a top of the first end wall 146. The lower edge 216 extends along a bottom of the first end wall 145.

The first end wall 146 may be remote from the base 144 such that the lower edge 216 is displaced a vertical distance (in the Y direction) from the base 144. The first end wall 146 is positioned vertically above the base 144 defining a gap 222 between the lower edge 216 and the base 144. Optionally, the first end wall 146 may extend between the upper section 202 of the first side wall 126 and the upper section 210 of the second side wall 128. Optionally, the first end wall 146 may include support beams (not shown) extending vertically from the base 144 along the lower section 222 configured to provide structural support for the first end wall 146. The second end wall 148 is vertically offset (for example, when the mating axis 140 is oriented vertically) with respect to the first end wall 146. In an exemplary embodiment, the upper edge 218 of the second end wall 148 is vertically offset below the lower 216 edge of the first end wall 146.

The base 144 may include a first keyed portion 244 and a second keyed portion 246 (shown in FIG. 3 and FIG. 4) extending along opposite ends 192, 194 of the housing 130. The first keyed portion 244 at least partially extends between the first side wall 126 and the second side wall 128 along the first end 192 of the base 144. The second keyed portion 246 (shown in FIG. 3 and FIG. 4) extends between the first side wall 126 and the second side wall 128 along the second end 194 of the base 144. The first keyed portion 244 has a shape that is complementary to the second keyed portion 246 such that, when multiple electrical connectors 116 are stacked side-by-side closely adjacent to each other, the first keyed portion 244 of electrical connector 116 aligns with and mates to a second keyed portion 246 of electrical connector 118. The keyed portions 244, 246 encourage alignment between such electrical connectors 116, 118 when mating with the circuit board 110. For example, the first keyed portion 244 may include a wave pattern having alternating crests and troughs. The wave pattern on the first keyed portion 244 may then dovetail with a complementary wave pattern defining the second keyed portion 246.

Figure 5:
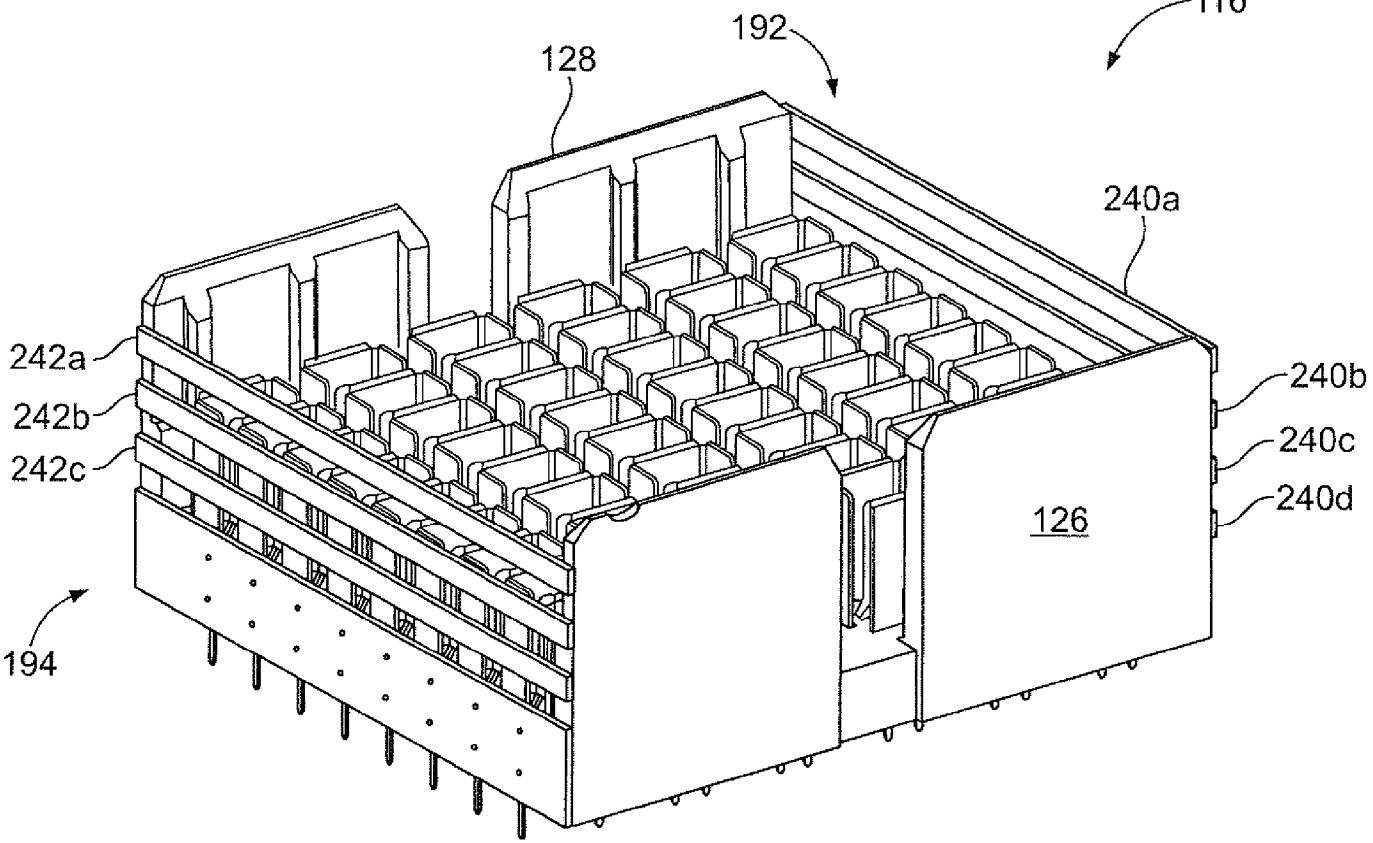
FIG. 5 is a front perspective view of an electrical connector having a plurality of end walls in accordance with an exemplary embodiment.

FIG. 5 is a perspective view of the electrical connector 116 having a plurality of end walls 240 in accordance with an embodiment. As shown in FIG. 5, the electrical connector 116 includes a plurality of end walls 240*a*, 240*b*, 240*c*, and 240*d* along the first end 192, and a plurality of end walls 242*a*, 242*b*, and 242*c* along the second end 194. Any number of end walls 240, 242 may be provided. The end walls 240 are vertically offset with respect to the end walls 242 such that when multiple electrical connectors 116 are stacked adjacent to each other, the end walls 240 of the first electrical connector 116 are interleaved with the second end walls 242 of the second electrical connector 116. Increasing the number of end walls 240 increases the amount of support for the side walls 126, 128. Additionally, the end walls 240 provide support for the side walls 126, 128 along both the lower sections 200, 208 (shown in FIG. 3) and the upper sections 202, 210 (shown in FIG. 3).

Figure 6:
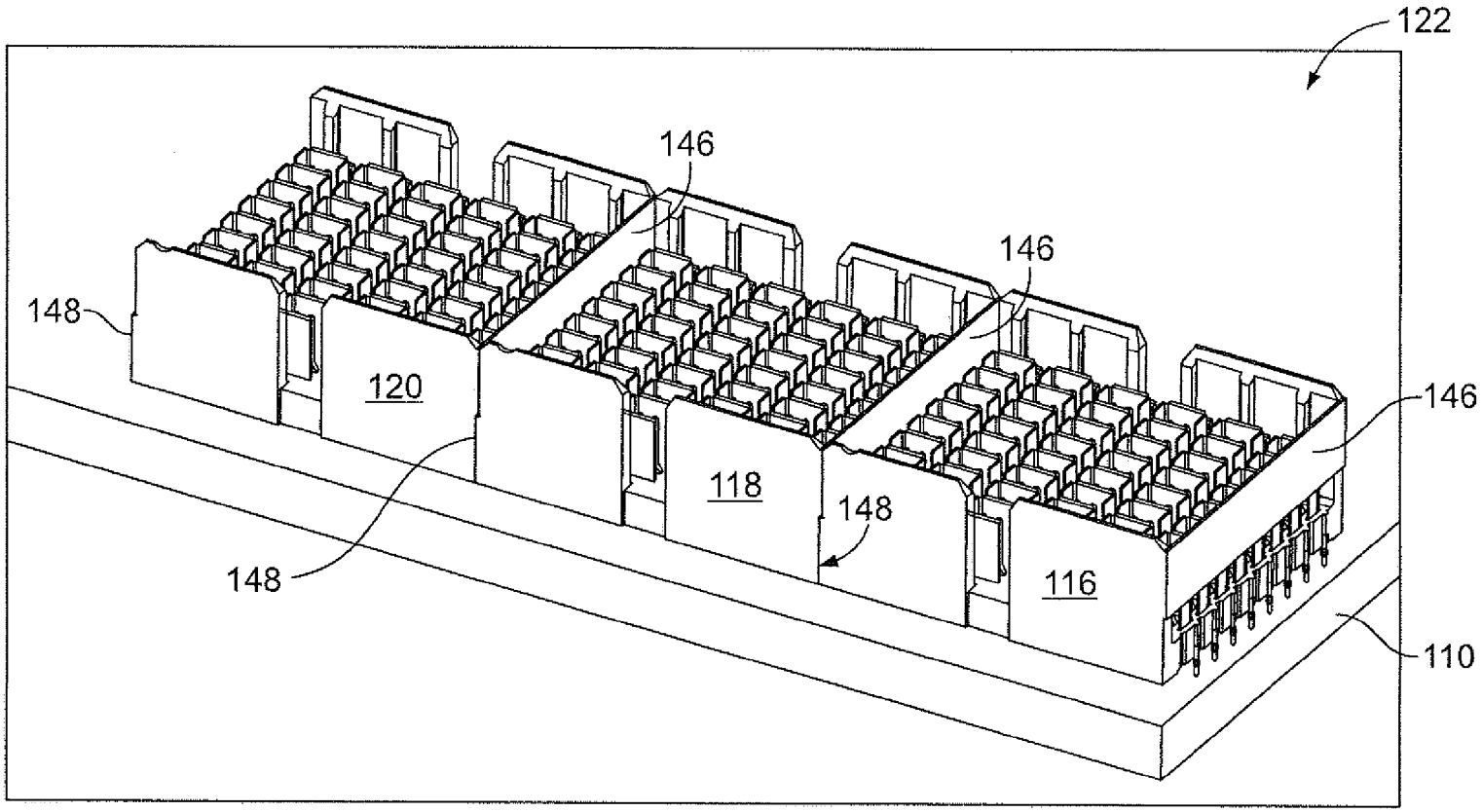
FIG. 6 is a perspective view of an electrical connector array mounted to a circuit board in accordance with an exemplary embodiment.

FIG. 6 is a perspective view of an electrical connector array 122 mounted to the circuit board 110 in accordance with an exemplary embodiment. The electrical connector array 122 includes first, second, and third electrical connectors 116, 118, and 120. In various embodiments, the electrical connector array 122 may include more or fewer electrical connectors. The second and third electrical connectors 118, 120 may be identical to the first electrical connector 116 and like components may be identified with like numerals. The electrical connectors 116, 118, and 120 may be mated to the circuit board 110 with tight spacing between the connectors 116, 118, and 120 in order to increase the number of signal contacts 134 in the assembly 102. In an embodiment, the connectors 116, 118 and 120 may abut against one another. The electrical connectors 116, 118, and 120 are positioned close to one another such that the first end wall 146 overlaps with the second end wall 148 of an adjacent electrical connector.

The second end wall 148 of the first electrical connector 116 is stacked vertically below the first end wall 146 of the second electrical connector 118. Additionally, the second end wall 148 of the second electrical connector 118 is configured to be stacked vertically below the first end wall 146 of the third electrical connector 120.

In various embodiments of the electrical connector array 122, the first electrical connector 116 may be identical to the third electrical connector 120, and the second electrical connector 118 may be different than the first and third electrical connectors 116, 120. For example, the first and third electrical connectors 116, 120 may include two upper end walls 146 on both ends extending between the upper portions of the side walls 126, 128, and neither includes any lower end walls 148. The second electrical connector 118 may then include two lower end walls 148 on both ends extending between the side walls 126, 128, but not include any upper end walls 146. The end walls 148 of the second electrical connector 118 may then interlock or internest with the end walls 146 of the first and third electrical connectors 116, 120.

Figure 7:
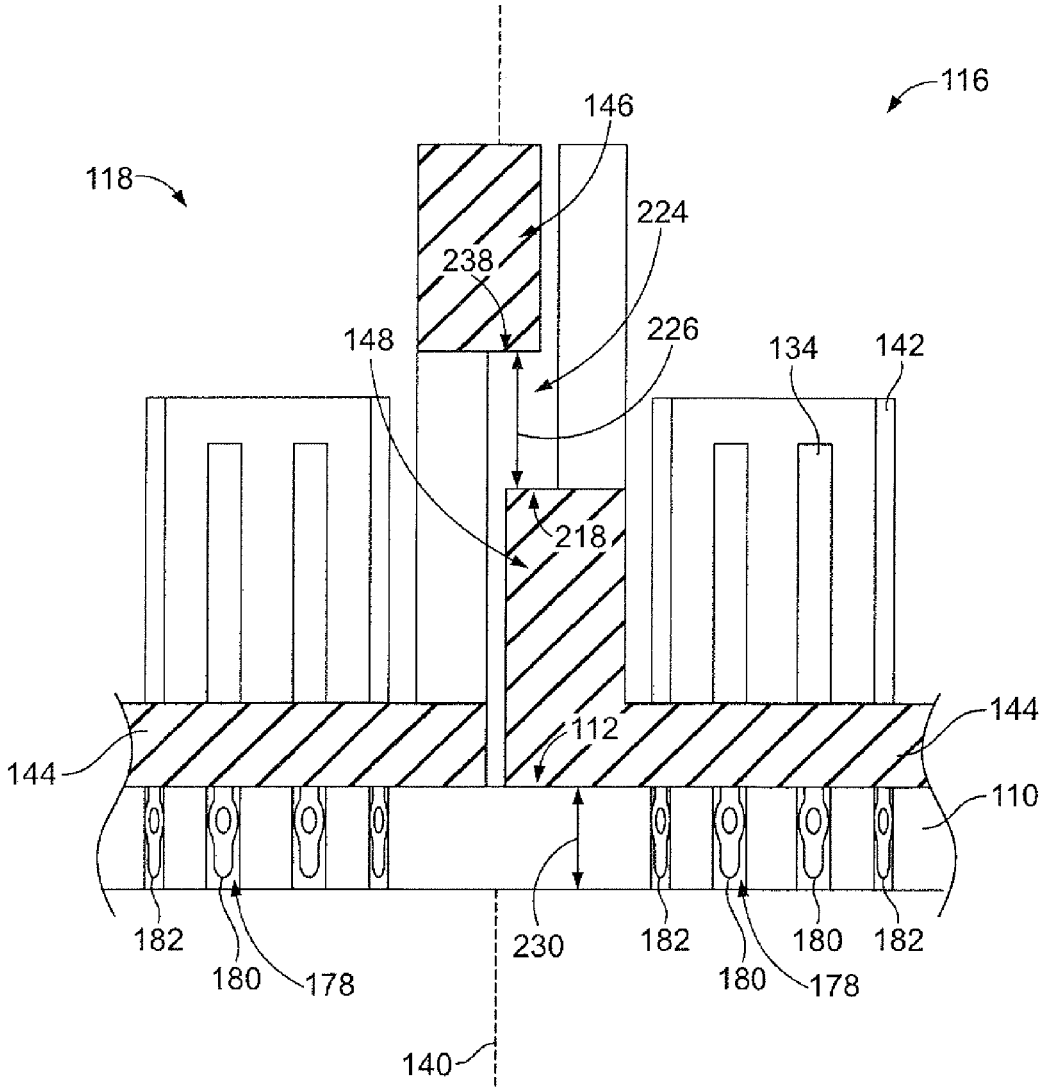
FIG. 7 is a partial cut-away elevation view of a first and second electrical connector mated to a circuit board in accordance with an exemplary embodiment.

FIG. 7 is a partial cut-away elevation view of the electrical connectors 116, 118 mated to the first side 112 of the circuit board 110 in accordance with an exemplary embodiment. The electrical connector 116 is positioned adjacent to the electrical connector 118 such that the base 144 of the electrical connector 116 is adjacent, and may abut against, the base 144 of the electrical connector 118.

The complaint pins 180, 182 of the signal contacts 134 and the ground contacts 142 extend through the base 144 and are through-hole mounted to the circuit board 110. Alternatively, the pins 180, 182 may be surface mounted to the circuit board 110. Alternatively, the signal contacts 134 may form a ball grid array (BGA). The compliant pins 180,182 extend below the base 144 by a distance 230.

The upper edge 218 of the second end wall 148 of the first electrical connector 116 and the lower edge 238 of the first end wall 146 of the second electrical connector 118 are vertically offset in the direction of the mating axis 140 and form a gap 224 therebetween. The distance between the surfaces of the upper edge 218 and the lower edge 238 defines a gap length 226. In an embodiment, the gap length 226 is greater than the distance 230. For example, the gap length 226 may be approximately 1.0 mm whereas the distance 230 may be approximately 0.75 mm. Having the gap length 226 greater than the distance 230 allows the first end wall 146 of the second electrical connector 118 to partially overlap the second end wall 148 of the first electrical connector 116 when the first and second electrical connectors 116, 118 are mounted on the circuit board 110. The second end wall 148 is positioned below the first end wall 146. The pins 180 may be aligned with the vias 178 and the second electrical connector 118 may be mounted to the circuit board 110 in a direction parallel to the mating axis 140.

Optionally, the upper edge 218 and the lower edge 238 may be chamfered or beveled to encourage alignment and/or to reduce the gap length 226. The upper edge 218 and the lower edge 238 may be chamfered at complementary angles (for example, 45°) to allow the second end wall to be loaded under the first end wall during mounting to the circuit board. Optionally or additionally, the upper edge 218 and the lower edge 238 may be chamfered to encourage mating with a mating connector, such as to guide the mating connector into the cavity.

In other embodiments, the electrical connectors 116, 118 may be designed to have no gap length 226. The upper edge 218 of the second end wall 148 of the first electrical connector 116 and the lower edge 238 of the first end wall 146 of the second electrical connector 118 may be configured to provide a friction fit therebetween. For example, for connectors having multiple end walls 240*a*-240*d* (shown in FIG. 5), gaps between the end walls of one electrical connector may be equal to widths of the end walls 242*a*, 242*b*, 242*c* (shown in FIG. 5) of the other electrical connector to allow the electrical connectors 116, 118 to snap together and be mounted to the circuit board 110 as a unit. Optionally, the upper edge 218 and the lower edge 238 may include keying components. For example, a first keying component (for example, a tongue or ridge) may extend along the surface of the upper edge 218. A second keying component (not shown) may extend along the surface of the lower edge 238. The first keying component (not shown) is configured to mate with second keying component (not shown) to resist side to side shifting of the electrical connectors 116, 118.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing holding an array of contacts, the housing having opposite first and second sides and opposite first and second ends, the housing comprising:

a base;

side walls extending from the base at the first and second sides of the housing with a cavity defined between the side walls, the contacts being arranged in the cavity, the cavity being configured to receive a mating connector along a mating axis extending in a vertical direction;

a first end wall at the first end of the housing extending between the opposite side walls; and a second end wall at the second end of the housing extending between the opposite side walls, the second end wall being vertically offset from the base with respect to the first end wall.

2. The electrical connector of claim 1, wherein the first end wall is remote from the base.

3. The electrical connector of claim 1, wherein the first end wall has an upper edge and a lower edge, the second end wall having an upper edge and a lower edge, the upper edge of the second end wall being disposed below the lower edge of the first end wall.

4. The electrical connector of claim 1, wherein the base includes a mounting surface at a bottom of the housing, the side walls extending to tips at a top of the housing, the end walls being vertically offset between the top and the bottom of the housing.

5. The electrical connector of claim 1, wherein the first end wall is positioned vertically above the base with a gap defined between the first end wall and the base.

6. The electrical connector array of claim 5, wherein the gap includes a gap length, the contacts having tails extending a distance below the base, wherein the gap length is greater than the distance.

7. The electrical connector of claim 1, wherein the side walls further comprise first and second side walls each having an upper section and a lower section, the first end wall extending between the upper sections of the first and second side walls at the first end of the housing, the second end wall extending between the lower sections of the first and second side walls at the second end of the housing.

8. The electrical connector of claim 1, further comprising a plurality of end walls at the first end of the housing and a plurality of end walls at the second end of the housing, the end walls at the first end of the housing being offset in the vertical direction with respect to the end walls at the second end of the housing.

9. The electrical connector of claim 1, wherein the first and second end walls are chamfered.

10. The electrical connector of claim 1, wherein the second end wall is configured to be stacked vertically below a first end wall of an adjacent electrical connector on a circuit board and wherein the first end wall is configured to be stacked vertically above a second end wall of an adjacent electrical connector on the circuit board.

11. The electrical connector of claim 1, wherein the contacts comprise signal contacts and ground contacts, the ground contacts providing electrical shielding between signal contacts.

12. An electrical connector array comprising:

a first electrical connector comprising an array of contacts and a first housing holding the contacts, the first housing having opposite first and second sides and opposite first and second ends, the first housing having a base, the first housing having side walls extending from the base at the first and second sides of the first housing with a cavity defined between the side walls, the contacts being arranged in the cavity, the cavity being configured to receive a mating connector along a mating axis extending in a vertical direction, the first housing having a first end wall at the first end of the first housing extending between the opposite side walls, and the first housing having a second end wall at the second end of the first housing extending between the opposite side walls; and a second electrical connector, the second electrical connector comprising an array of contacts and a second housing holding the contacts, the second housing having opposite first and second sides and opposite first and second ends, the second housing having a base, the second housing having side walls extending from the base at the first and second sides of the second housing with a cavity defined between the side walls, the contacts being arranged in the cavity, the cavity being configured to receive a mating connector along the mating axis, the second housing having a first end wall at the first end of the second housing extending between the opposite side walls, and the second housing having a second end wall at the second end of the second housing extending between the opposite side walls;

wherein the second electrical connector is adjacent to the first electrical connector and the first end wall of the second housing at least partially overlaps the second end wall of the first housing.

13. The electrical connector array of claim 12, further including a third electrical connector, the third electrical connector comprising an array of contacts, and a third housing holding the contacts, the third housing having opposite first and second sides and opposite first and second ends, the third housing having a base, the third housing having side walls extending from the base at the first and second sides of the third housing with a cavity defined between the side walls, the contacts being arranged in the cavity, the cavity being configured to receive a mating connector along a mating axis, the third housing having a first end wall at the first end of the third housing extending between the opposite side walls, and the third housing having a second end wall at the second end of the third housing extending between the opposite side walls;

wherein the third electrical connector is adjacent to the first electrical connector and the second end wall of the third housing at least partially overlaps the first end wall of the first housing.

14. The electrical connector array of claim 12, wherein the first end wall of the first electrical connector has an upper edge and a lower edge, the second end wall of the second electrical connector has an upper edge and a lower edge, the upper edge of the second end wall of the second electrical connector facing the lower edge of the first end wall and being vertically offset below the lower edge of the first end wall of the first electrical connector.

15. The electrical connector array of claim 14, wherein the lower edge of the first end wall is positioned above the upper edge of the second end wall with a gap therebetween.

16. The electrical connector array of claim 15, wherein the gap includes a gap length, the contacts having tails extending a distance below the base, wherein the gap length is greater than the distance.

17. The electrical connector array of claim 12, wherein the first end wall of the first electrical connector and the second end wall of the second electrical connector are chamfered to allow the second end wall of the second electrical connector to be loaded under the first end wall of the first electrical connector at an angle during mounting to a circuit board.

18. The electrical connector array of claim 12, wherein the first electrical connector further comprises a plurality of end walls at the first end of the first housing and the second electrical connector further comprises a plurality of end walls at the second end of the second housing, the end walls at the second end of the second housing being vertically offset with respect to the end walls of the first electrical connector and interleaved with respect to the end walls of the first end of the first housing.

19. The electrical connector array of claim 12, wherein the second end wall of the first electrical connector is vertically offset with respect to the first end wall of the first electrical connector, and wherein the second end wall of the second electrical connector is vertically offset with respect to the first end wall of the second electrical connector.

20. The electrical connector array of claim 12, wherein the second end wall of the second electrical connectors extends along an end of the base of the second electrical connector, the first end of the first electrical connector wall is positioned vertically above the base of the first electrical connector with a gap defined between the first end wall and the base.

* * * * *